US010508401B2

(12) United States Patent
Bohnert

(10) Patent No.: US 10,508,401 B2
(45) Date of Patent: Dec. 17, 2019

(54) DEPTH VIBRATOR WITH ADJUSTABLE IMBALANCE

(71) Applicant: KELLER HOLDING GMBH, Offenbach (DE)

(72) Inventor: Peter Bohnert, Renchen/Ulm (DE)

(73) Assignee: Keller Holding GmbH, Offenbach/Main (DE)

( * ) Notice: Subject to any disclaimer, the term of this patent is extended or adjusted under 35 U.S.C. 154(b) by 0 days.

(21) Appl. No.: 16/117,498

(22) Filed: Aug. 30, 2018

(65) Prior Publication Data

US 2019/0071831 A1 Mar. 7, 2019

(30) Foreign Application Priority Data

Sep. 5, 2017 (EP) ..... 17189317

(51) Int. Cl.

| | |
|---|---|
| ***E02D 3/068*** | (2006.01) |
| ***E02D 3/054*** | (2006.01) |
| ***E01C 19/28*** | (2006.01) |
| *B06B 1/16* | (2006.01) |

(52) U.S. Cl.

CPC ..... *E02D 3/068* (2013.01); *E01C 19/286* (2013.01); *E02D 3/054* (2013.01); *B06B 1/164* (2013.01)

(58) Field of Classification Search

CPC combination set(s) only.
See application file for complete search history.

(56) References Cited

FOREIGN PATENT DOCUMENTS

| | | | | |
|---|---|---|---|---|
| DE | 19930884 | 2/2001 | | |
| DE | 102014019139 A1 | 6/2016 | | |
| FR | 2639376 A1 * | 5/1990 | ..... | B06B 1/164 |
| WO | WO-2016102432 A1 * | 6/2016 | ..... | E02D 3/054 |

OTHER PUBLICATIONS

Keller, Die Tiefenruttelverfahren; pp. 1-12; Keller—Ein Unternehmen der Keller Group plc.

* cited by examiner

*Primary Examiner* — Kyle Armstrong
(74) *Attorney, Agent, or Firm* — Royal W. Craig; Gordon Feinblatt LLC

(57) ABSTRACT

A depth vibrator for compacting soil, comprising a rotary drive (3); a drive shaft (4), which is rotatingly drivable about a rotary axis (A) by the rotary drive (3) in a first rotation direction (R1) and in an opposite second rotation direction (R2); a primary mass body (5) connected non-rotatably to the drive shaft (4) and rotates together with the latter about the rotary axis (A); a secondary mass body (6), which is movable into a first rotation position (P1) relative to the primary mass body (5) by rotation of the drive shaft (4) in the first rotation direction (R1) and which is movable into a second rotation position (P2) by rotation of the drive shaft (4) in the second rotation direction (R2). In the first and second rotation position (P1) the secondary mass body (6) can be rotated together with the primary mass body (5) about the rotary axis (A); and the center of mass (S6) of the secondary mass body (6) and the center of mass (S5) of the primary mass body (5) have different radial distances from the rotary axis (A).

18 Claims, 4 Drawing Sheets

DEPTH VIBRATOR WITH ADJUSTABLE IMBALANCE

CROSS-REFERENCE TO RELATED APPLICATION(S)

The present application claims priority under 35 U.S.C. § 119 from European Patent Application 17189317.5 filed 5 Sep. 2017, the disclosure of which is incorporated by reference herein in its entirety.

BACKGROUND OF THE INVENTION

1. Field of the Invention

This invention relates to a depth vibrator for compacting soil by means of a rotating imbalance. The rotating imbalance generates vibrations, with which the depth vibrator compacts the soil and possible additional material.

2. Description of the Background

Depth vibrators are generally used for three methods of subsoil improvement, which differ from one another with regard to the mode of functioning and the load transfer. With the vibro-compaction method, coarse-grained soils are compacted in themselves. With the vibro-displacement method, load-transferring columns of grit or gravel are introduced into mixed- and/or fine-grained, non-compactable soils. With the third method, pile-like foundation elements are produced, by means of which relatively high loads can be transferred if a sustainable connection with displacement columns is not guaranteed. The different depth vibration methods are also described in the applicant's brochure, Keller Grundbau GmbH, Die Tiefenruttelverfahren ¨(in German), Brochure 10-02D.

All the methods have in common the fact that the vibrator is sunk in the ground to an intended improvement depth and then, depending on the type of method, soil is compacted from the bottom upwards, a displacement column is built up or a pile-like foundation element is produced.

As an essential element, the vibrator contains a motor-driven imbalance, which sets the vibrator into horizontal vibrations. The depth vibrator is adapted to the intended working depth by means of attachment pipes and guided by cranes, excavators or specially developed support devices (caterpillars).

A depth vibrator for compacting a soil with a first imbalance weight and a fastening element for the exchangeable mounting of a second imbalance weight is known from DE 102014019139. The first imbalance weight and the second imbalance weight can be driven in a rotating manner about the longitudinal axis of the depth vibrator. The fastening element is arranged so that the imbalance of the depth vibrator can be reduced by the incorporated second imbalance weight.

A depth vibrator for compacting soils with an elongated housing with a longitudinal axis and a motor-driven rotary axis mounted coaxially in the housing as well as an imbalance mass rotating with the rotary axis (see DE19930884A1). Means for changing the radial distance of the center of gravity of the imbalance mass from the longitudinal axis and a speed-variable drive for the rotary axis are provided. By changing the magnitude of the imbalance mass, the effective impact force during the sinking and/or extraction is changed.

In the case of depth vibrators where the eccentric is non-adjustable, and the centrifugal forces and amplitude of the vibrator will have to be established during the assembly. During operation, there is only very limited scope, by changing the speed, for reacting to different soil properties.

Depth vibrators with an adjustable eccentric require a mechanical device for adjusting the imbalance masses. The adjustment mechanism, however, is subject to high loads on account of the strong vibrations, which high loads can lead to failure of individual mechanical parts.

SUMMARY OF THE INVENTION

The problem underlying the present invention, therefore, is to propose a depth vibrator with an adjustable imbalance mass, which is constructed in a simple and robust manner and therefore has a long useful life. Furthermore, a corresponding method for compacting soil is to be proposed, which enables a change to the imbalance mass during the operation.

For the solution, a depth vibrator for compacting soil is proposed, comprising a rotary drive, which can be driven in a rotating manner in two rotation directions, a drive shaft, which is connected in a drivable manner to the rotary drive, a primary mass body, which is connected non-rotatably to the drive shaft and rotates together with the latter about the rotary axis, a secondary mass body, which is rotatable to a limited extent relative to the primary mass body and occupies a first rotation position relative to the primary mass body when the drive shaft is rotated in the first rotation direction, in which rotation position a center of gravity of the secondary mass body is brought closer to the center of gravity of the primary mass body, and occupies a second rotation position relative to the primary mass body when the drive shaft is rotated in the second rotation direction, in which second rotation position the center of gravity of the secondary mass body is spaced apart from the center of gravity of the primary mass body, wherein the center of mass of the secondary mass body and the center of mass of the primary mass body have different radial distances from the rotary axis.

An advantage is that the imbalance can be changed between two magnitudes by a simple reversal of the direction of rotation of the rotary drive, wherein, on account of the embodiment of the first and secondary mass body such that the centers of gravity lie on different radii, particularly high imbalances can be achieved or a large variability with regard to the adjustable imbalances is provided. The effect of this is that the amplitude of the depth vibrator can be adjusted in particularly large ranges by means of the displacement. Depending on the mass and shape of the secondary mass body, the amplitude in the first rotation position can be more than doubled compared to the second rotation position. For the adjustment of the imbalance, the direction of rotation of the rotary drive merely has to be changed, for which purpose the latter has to be briefly stopped.

With regard to the embodiment of the mass bodies and, accordingly, the position of the respective centers of mass of the primary mass body connected non-rotatably to the drive shaft on the one band and of the secondary mass body rotatable relative to the drive shaft on the other hand, various possibilities are conceivable. According to a first possibility, the rotatable secondary mass body has a greater radial distance from the rotary axis than the non-rotatable primary mass body. Alternatively, the reverse is also possible, i.e. the primary mass body connected non-rotatably to the shaft has a greater radial distance from the rotary axis than the rotatable secondary mass body in this regard.

The rotary drive can have any embodiment which is suitable for generating a rotary movement in two rotation directions. For example, the rotary drive can be constituted in the form of an electric motor or a hydraulic drive. The electric motor can comprise a stator connected non-rotatably to a housing of the depth vibrator or supported with respect to the latter in the sense of rotation, as well as a rotor connected to a motor shaft in order to drive the latter.

The drive shaft, which carries the primary and secondary mass bodies, is connected to the rotary drive in a drivable manner. With the expression "connected in a drivable manner", an indirect connection of the aforementioned drive parts is intended to be included in the context of the present disclosure, i.e. the possibility that one or more further components can be interconnected in the power path between the rotary drive and the drive shaft, for example a coupling or a gear unit.

The term "primary mass body" is intended in the present case to mean in particular at least one mass body connected non-rotatably to the drive shaft. A "secondary mass body" denotes in the present case a mass body which can be adjusted relative to the primary mass body, so that the center of gravity of the total mass changes. One or more primary and secondary mass bodies can be provided. Accordingly, One skilled in the art will understand that, within the scope of the disclosure, each reference to a primary or secondary mass body can also apply to each further corresponding primary or secondary mass body.

The masses of the primary and the secondary mass body can be selected as required and according to the desired amplitude of the depth vibrator. A great variability can be achieved if the primary and secondary mass bodies have masses of different magnitude. The primary mass body compared to the secondary mass body can have a larger or smaller mass. It is advantageous in terms of a large vibration amplitude if the mass body, the center of gravity of which has the greater distance from the rotary axis, also has the greater mass. This may be the primary or secondary mass body. It is also conceivable that the masses of the primary and secondary mass body are of equal magnitude.

Provision is in particular made so that the center of mass resulting from the primary mass body and the secondary mass body in the first rotation position has a greater distance from the rotary axis than the center of mass resulting from the primary mass body and the secondary mass body in the second rotation position. The centers of mass of the primary and secondary mass body in the first rotation position preferably lie on a common side and in the second rotation position on opposite sides relative to the rotary axis of the drive shaft.

According to a preferred embodiment, a first stop is provided, against which the secondary mass body is supported when the rotary drive is rotated in the first rotation direction, and a second stop, against which the secondary mass body is supported when the rotary drive is rotated in the second rotation direction. A particularly straightforward structure is achieved by the fact that the first and second stop are formed on a common stop element, for example as two stop faces of the stop element acting in opposite rotation directions. Precisely one stop element per secondary mass body, which forms the first rotation stop and the second rotation stop, is preferably provided for an imbalance assembly, which comprises a primary mass body and a secondary mass body.

According to a possible embodiment, the stop element can be provided on the primary mass body, by being fixedly connected to the latter. The connection of the stop element to the primary mass body can take place for example by means of a screw connection, wherein other connections such as a weld joint are also conceivable. The stop element can be constituted for example in the form of a stop bar, which is fixedly connected to the primary mass body and extends parallel to the rotary axis along an outer circumferential surface of the primary mass body.

According to a possible embodiment, the first mass body comprises a cylindrical segment, which preferably extends over approximately 180° about the rotary axis. The mass body can be produced in one piece with the drive shaft. Alternatively, the mass body can also be first produced separately and then connected to the drive shaft non-rotatably and axially fixed, for example by means of shaft toothing or a shaft-hub connection with suitable axial securing means.

The secondary mass body can comprise an annular segment, which is mounted rotatably about the drive shaft. The annular segment can extend for example over more than 160° and/or less than 180° about the rotary axis.

According to a first possibility, the secondary mass body can be arranged with an axial overlap with respect to the primary mass body. The mass bodies are preferably constituted such that a smallest inner radius of an annular segment of the secondary mass body is greater than a greatest outer radius of the primary mass body. In other words, the secondary mass body in the first rotation position lies radially outside the primary mass body. According to an advantageous development, the secondary mass body in this embodiment comprises an upper cover part, connected fixedly to an upper end of the annular segment, and a lower cover part, connected fixedly to a lower end of the annular segment, wherein the two cover parts are rotatably mounted radially on the inside at least indirectly on the drive shaft. In this embodiment, the primary mass body in the first rotation position is accommodated spatially in the secondary mass body. As a result of the fact that the annular segment of the secondary mass body lies radially outside the primary mass body, a particularly large imbalance and, correspondingly, also a large vibration amplitude are generated.

According to a second possibility, the secondary mass body can also be arranged with an axial offset with respect to the primary mass body, i.e. above and/or below a respective axial end of the primary mass body. This embodiment is particularly suitable for applications in which only a small additional imbalance or increase in amplitude is required.

For both possibilities, it is the case that the secondary mass body is arranged at least partially radially outside the primary mass body or that the center of mass of the secondary mass body has a greater radial distance from the rotary axis than the center of mass of the primary mass body. The stop element is constituted corresponding to the embodiment of the secondary mass body. Particularly in the case of the first possibility, the stop element can be constituted radially protruding with respect to an outer circumferential surface of the primary mass body, in order to act as a driver for the secondary mass body during rotation of the drive shaft. For a particularly large contact area, the stop element can extend in the axial direction over at least a third of the height of the primary mass body. In the case of the second possibility, the stop element can in particular protrude axially with respect to an axial end side of the primary mass body.

In order to generate a particularly large imbalance mass, at least one of the primary and the secondary mass bodies can contain heavy metal. Furthermore, a plurality of primary and/or secondary mass bodies can also be provided.

An imbalance assembly, which is to be mounted as a unit in a housing of the depth vibrator, can in each case comprise at least one shaft part, a primary and a secondary mass body. The shaft part is mounted rotatably in the housing of the depth vibrator by means of an upper bearing, which is arranged above the primary mass body, and by means of a lower bearing, which is arranged below the primary mass body.

According to an embodiment for particularly good vibration amplitudes, a plurality of imbalance assemblies can be provided, which are arranged below one another. The individual imbalance assemblies are preferably driven by a single rotary drive. For this purpose, the motor shaft of the rotary drive can be connected non-rotatably to the drive shaft of a first assembly and the first drive shaft can also be connected non-rotatably to the drive shaft of a second assembly lying below. An arbitrary number of further imbalance assemblies is possible. The non-rotatable connection of the individual shaft parts to one another can be implemented for example by means of a flange connection, shaft toothing or other shaft-hub connection. Each individual assembly preferably has separate bearings for mounting the respective shaft part, in order that the bearing load overall is small. It is thus guaranteed that the depth vibrator durably withstands forces and vibrations also in the case of an embodiment with a plurality of imbalance assemblies.

A method for compacting the soil by means of such a depth vibrator can comprise the following steps: vibro-driving of the depth vibrator into the soil up to a desired depth by rotating the rotary drive in a first or second rotation direction and compacting the soil by rotating the rotary drive in the second rotation direction. By rotating the rotary drive in the second rotation direction, large vibration amplitudes and therefore a high level of compaction are generated. The vibro-driving down to the desired depth can take place with a small or large amplitude.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

Figure 1:
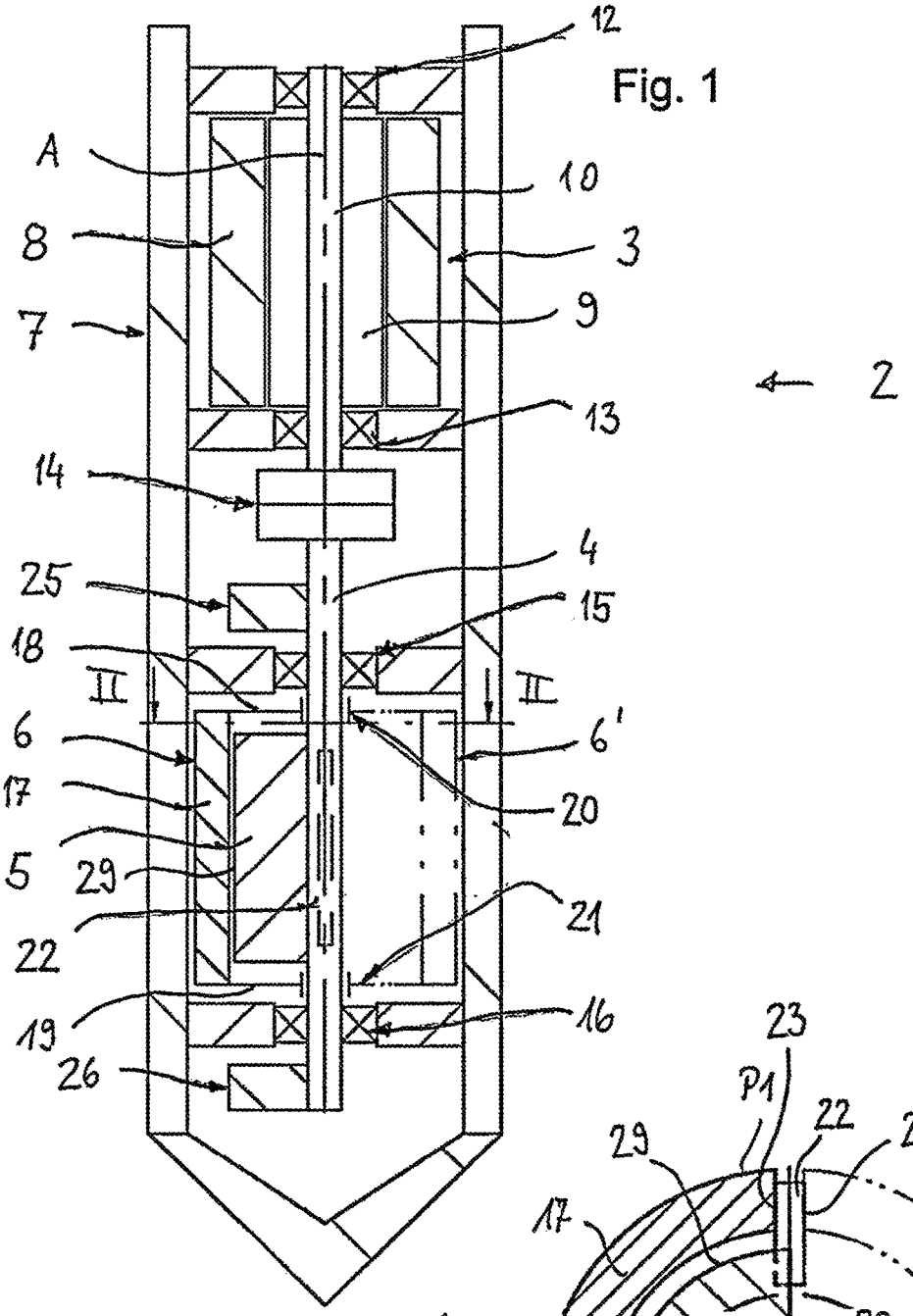
FIG. 1 shows a depth vibrator in a first embodiment in a longitudinal cross-section.

FIGS. 1 to 7 are first described below jointly with regard to their common features. A portion of a depth vibrator 2 is represented. A depth vibrator 2 serves to compact soil by means of an imbalance. An imbalance is understood to mean a rotating body, the mass whereof is not distributed rotation-symmetrically. The mass inertia axis of the mass body 5 is offset relative to the rotation axis, so that the imbalance generates vibrations during rotation, with which the soil and possible additive material is compacted.

The depth vibrator 2 accordingly comprises a rotary drive 3, a drive shaft 4 driven in a rotating manner by the latter, a first mass body 5, which is connected non-rotatably to drive shaft 4, as well as a second mass body 6, which can be adjusted in the sense of rotation with respect to first mass body 5. The aforementioned components are accommodated in a housing 7 of depth vibrator 2, or mounted rotatably in the latter. Provision is made such that first and second mass bodies 5, 6 differ from one another with regard to their shape and/or mass and/or their respective distance of the center of gravity from drive shaft 4.

Rotary drive 3 constitutes an electric motor, which comprises a stator 8 supported in the sense of rotation with respect to housing 7, and a rotor 9 rotatable with respect thereto. One skilled in the art will understand that other motors can also be used, for example a hydraulic drive. Rotor 9 of electric motor 3 is connected to a motor shaft 10, in order to drive the latter in a rotating manner. Motor shaft 10 is mounted rotatably about a rotary axis in housing 7 by means of a first bearing 12, which is arranged above rotary drive 3, and a second bearing 13, which is arranged below rotary drive 3. Rotary drive 3 is constituted such that it can drive motor shaft 10 in two rotation directions, i.e. in the clockwise direction and in the anticlockwise direction.

Motor shaft 10 is connected non-rotatably by means of suitable connection means 14 to drive shaft 4 lying beneath for the transmission of a torque. Connection means 14 are constituted in the present case in the form of a flange connection, wherein One skilled in the art will understand that other shaft couplings for the non-rotatable connection are just as possible.

Drive shaft 4 is mounted rotatably in housing 7 by means of suitable bearing means 15, 16, for example by means of roller bearings or sliding bearings. First mass body 6, which can also be referred to as the primary mass body, is connected non-rotatably to drive shaft 4. The non-rotatable connection can be implemented by known means, for example in a form-fit manner by means of a shaft-hub connection and/or in a firmly bonded manner by means of a weld joint. It is also possible for drive shaft 4 to be produced in one piece with first mass body 6.

Second mass body 6, which can also be referred to as the secondary mass body, is rotatable to a limited extent relative to first mass body 5. As seen in FIG. 2, provision is made such that secondary mass body 6 occupies a first rotation position P1 when drive shaft 4 is rotated in first rotation direction R1 and a second rotation position P2 relative to first mass body 5 when drive shaft 4 is rotated in opposite second rotation direction R2. In first rotation position P1, which can be seen in FIGS. 1 to 5 in each case in the left-hand half of the image, secondary mass body 6 is moved closer to primary mass body 5, or the two mass bodies 5, 6 are located on the same side relative to rotary axis A. In second rotation position P2 of swiveling mass body 6, which is represented dashed in each case in the right-hand half of the image in FIGS. 1 to 5 (reference number 6'), secondary mass body 6 is arranged spaced apart from primary mass body 5, or the two mass bodies 5, 6 are located on opposite half-sides relative to rotary axis A. It emerges from this embodiment that resultant center of mass Sres1 formed from first and second mass bodies 5, 6 in first position P1 of mass body 6 has a greater radial distance from rotary axis A than resultant center of mass Sres2, which emerges from first and second mass bodies 5, 6 when secondary mass body (6') is located in second position P2. It follows from this that the magnitude of the imbalance can be changed between two magnitudes by a simple rotation direction reversal (R1, R2) of rotary drive 3. For the displacement of the imbalance, direction of rotation R1, R2 of rotary drive 3 merely has to be changed, for which purpose the latter briefly has to be stopped.

A particular feature of the present invention is that center of mass S6 of swiveling mass body 6 has a greater radial distance from rotary axis A than center of mass S5 of mass body 5 connected non-rotatably to shaft 4, or that swiveling mass body 6 protrudes at least partially radially with respect to non-rotatable mass body 5. As a result of this embodiment, particularly high imbalances can be achieved in first rotation position P1, or the amplitude of depth vibrator 2 can be adjusted in particularly large ranges. Depending on the mass and shape of secondary mass body 6, the amplitude in first rotation position P1 can be more than doubled compared to second rotation position P2.

Figure 2:
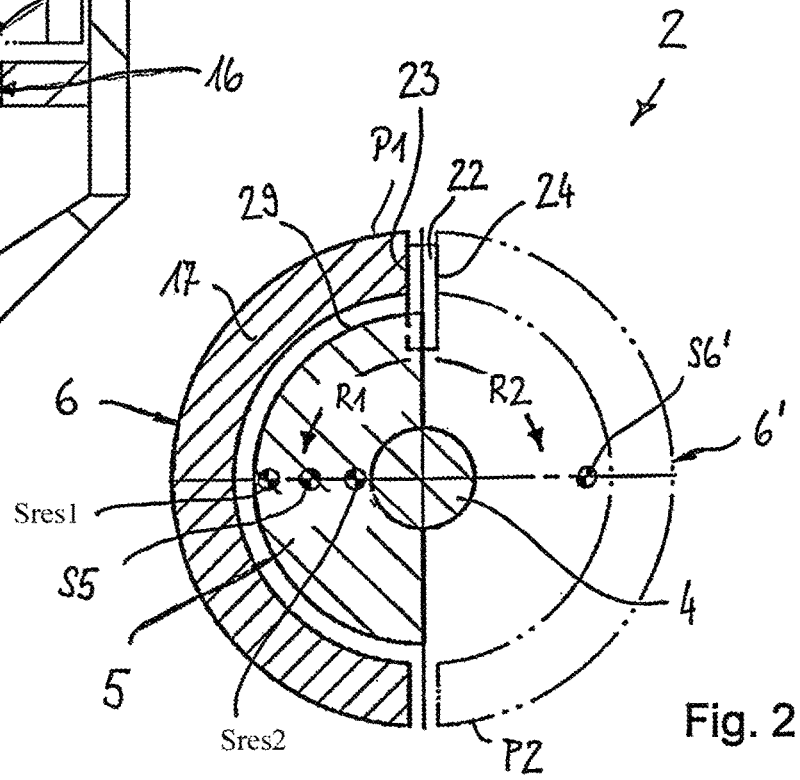
FIG. 2 shows the depth vibrator from FIG. 1 in cross-section according to intersecting line II-II from FIG. 1.

In the embodiment shown in FIGS. 1 and 2, primary mass body 5 comprises a cylindrical segment, which extends over 180° about rotary axis A. In this embodiment, secondary mass body 6 is arranged with an axial overlap with respect to primary mass body 5 and comprises an annular segment 17 with an upper cover part 18 and a lower cover part 19. Upper cover part 18, annular segment 17 and lower cover part 19 form a half-shell, which is dimensioned such that first mass body 5 can be accommodated therein when second mass body 6 is in first rotation position P. For this purpose, a smallest inner radius of annular segment 17 of secondary mass body 6 is greater than a greatest outer radius of primary mass body 6. In first rotation position P1, secondary mass body 6 lies radially outside primary mass body 5 and surrounds the latter. As a result of the fact that annular segment 17 of secondary mass body 6 lies radially outside primary mass body 5, a particularly great imbalance and, correspondingly, also a great vibration amplitude are generated.

The bearing of half shell-shaped mass body 5 on drive shaft 4 takes place by means of two bearings 20, 21. Upper cover part 18 is mounted rotatably on shaft 4 means of first bearing 20, which is arranged axially above first mass body 5, and lower cover part 19 by means of a second bearing 21, which is arranged axially beneath first mass body 5. It can be seen in particular in FIG. 2 that annular segment 17 extends over an angular region of somewhat less than 180° about rotary axis A.

Relative rotation positions P1, P2 are each defined by a stop element 22, against which secondary mass body 6 strikes when rotary drive 3 rotates and is thus arranged in a defined rotation position relative to primary mass body 5. In the present case, precisely one stop element 22 is provided, which forms both a stop in first rotation direction R1 and also a stop in second rotation direction R2. Stop element 22 is constituted in the present case in the form of a strip or bar, which is fixedly connected to primary mass body 5, for example in a form-fit manner by means of screw connections or firmly bonded by means of welding. Stop element 22 protrudes radially above an outer circumferential surface of primary mass body 5 and extends in the axial direction, as can be seen in particular in FIG. 1, over at least half the axial length of primary mass body 5, so that the most uniform possible force introduction or support of secondary mass body 6 is provided. A first lateral face 23 of strip 22 forms a first stop in first rotation direction R1 of swiveling mass body 6, whilst an opposite second lateral face 24 of strip 22 forms a second stop in opposite rotation direction R1 of mass body 6.

Figure 3:
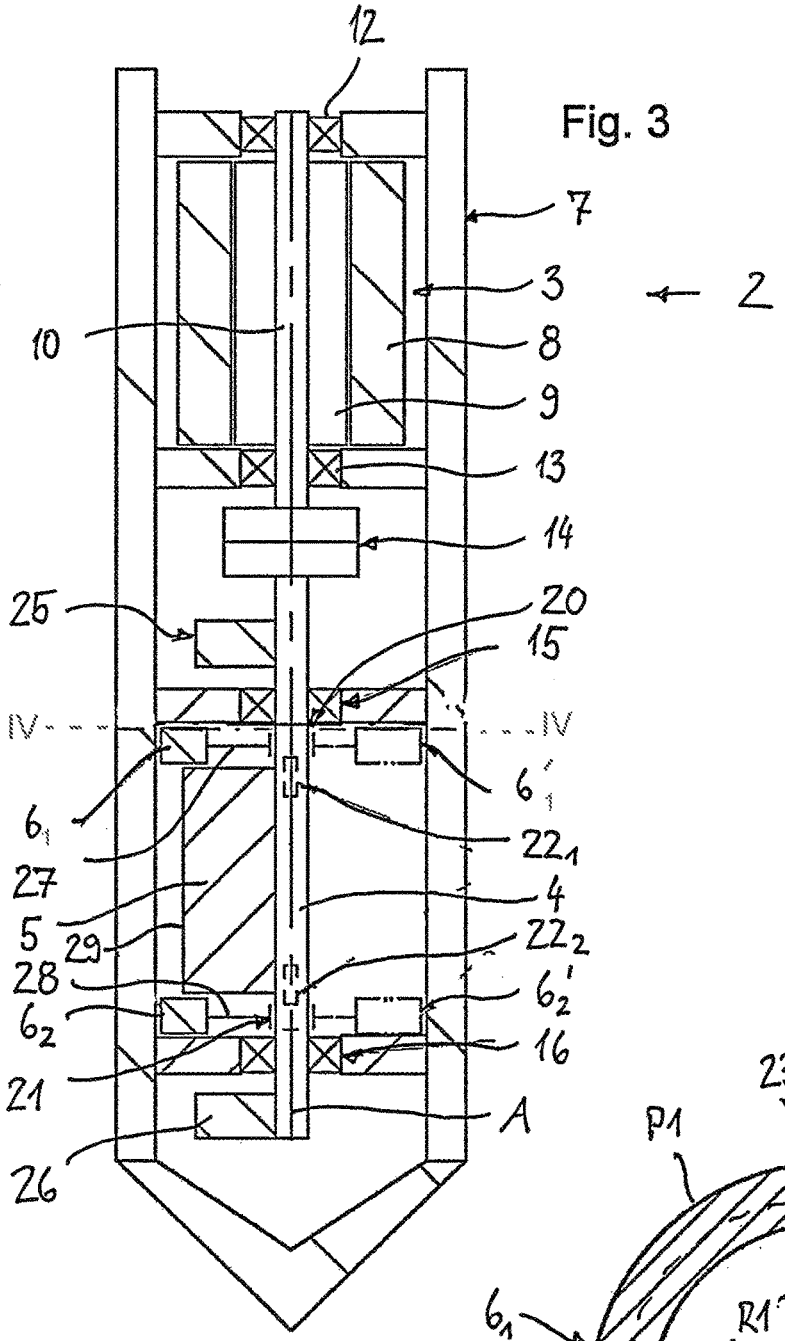
FIG. 3 shows a depth vibrator in a second embodiment in a longitudinal cross-section.

In the embodiments according to FIGS. 1 and 3, optional additional masses 25, 26 are also provided, which are connected fixedly to drive shaft 4. In the present case, a first additional mass 25 is arranged above first bearing 15 and a second additional mass 26 is arranged below second bearing 16. The non-rotatable connection to shaft 4 can be produced for example by means of a form-fit shaft-hub connection. Provision can be made such that at least one of mass bodies 5, 6, 25, 26 contains heavy metal. Moreover, the mass bodies can be produced from a metallic material, such as steel.

Figure 4:
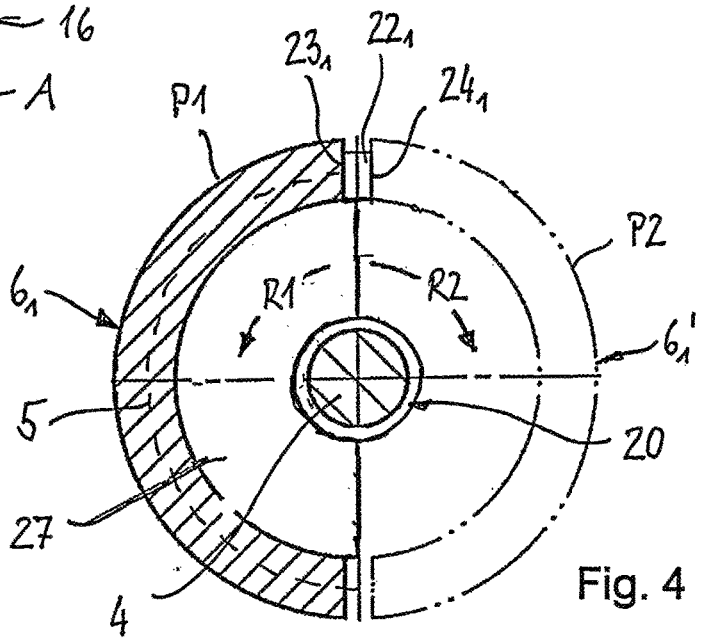
FIG. 4 shows the depth vibrator from FIG. 3 in cross-section according to intersecting line IV-IV from FIG. 3.

FIGS. 3 and 4 show a depth vibrator 2 in a somewhat modified second embodiment. The latter corresponds for the most part to the embodiment according to FIGS. 1 and 2, so that reference is made to the above description with regard to the common features. Identical or modified details are provided with the same reference numbers as in FIGS. 1 and 2.

In contrast with the above embodiment, two swiveling secondary mass bodies $\mathbf{6}_1$, $\mathbf{6}_2$ as provided in the present case in the embodiment according to FIGS. 3 and 4, which in each case are mounted rotatably on the drive shaft 4. A first swiveling mass body $\mathbf{6}_1$ is arranged above primary mass body 5 and is mounted on shaft 4 by means of a connecting bridge 27 and upper bearing 20. A second swiveling mass body $\mathbf{6}_2$ is arranged below primary mass body 5 and is connected in a swiveling manner to shaft 4 by means of a connecting bridge 28 or a lower bearing 21. The two secondary mass bodies $\mathbf{6}_1$, $\mathbf{6}_2$ are constituted in the form of annular segments, which extend over approximately 180° about rotary axis A. It can be seen in particular in FIG. 3 that an outer circumferential surface of secondary mass bodies $\mathbf{6}_1$, $\mathbf{6}_2$ protrude radially with respect to an outer circumferential surface of primary mass body 5. It follows from this that centers of mass S$\mathbf{6}_1$, S$\mathbf{6}_2$ of secondary mass bodies $\mathbf{6}_1$, $\mathbf{6}_2$ have a greater radial distance from rotary axis A than center of mass S5 of primary mass body 5.

In the present embodiment, two stops $\mathbf{22}_1$, $\mathbf{22}_2$ are also provided corresponding to the number of swiveling masses $\mathbf{6}_1$, $\mathbf{6}_2$, which stops are each connected to primary mass body 5. Stops $\mathbf{22}_1$, $\mathbf{22}_2$ in each case project axially beyond an end front face and protrude radially above an outer circumferential surface 29 of primary mass body 5. They are constituted in the form of fairly short bars, which moreover, as in the embodiment described above, can be connected to mass body 5. The present embodiment is constructed radially somewhat smaller, since a radial overlap between swiveling mass bodies $\mathbf{6}_1$, $\mathbf{6}_2$ and non-rotatable mass body 5 is provided. As for the rest, the structure and mode of functioning correspond to the above embodiment, to the description whereof reference is made in this regard to avoid repetition.

Figure 5:
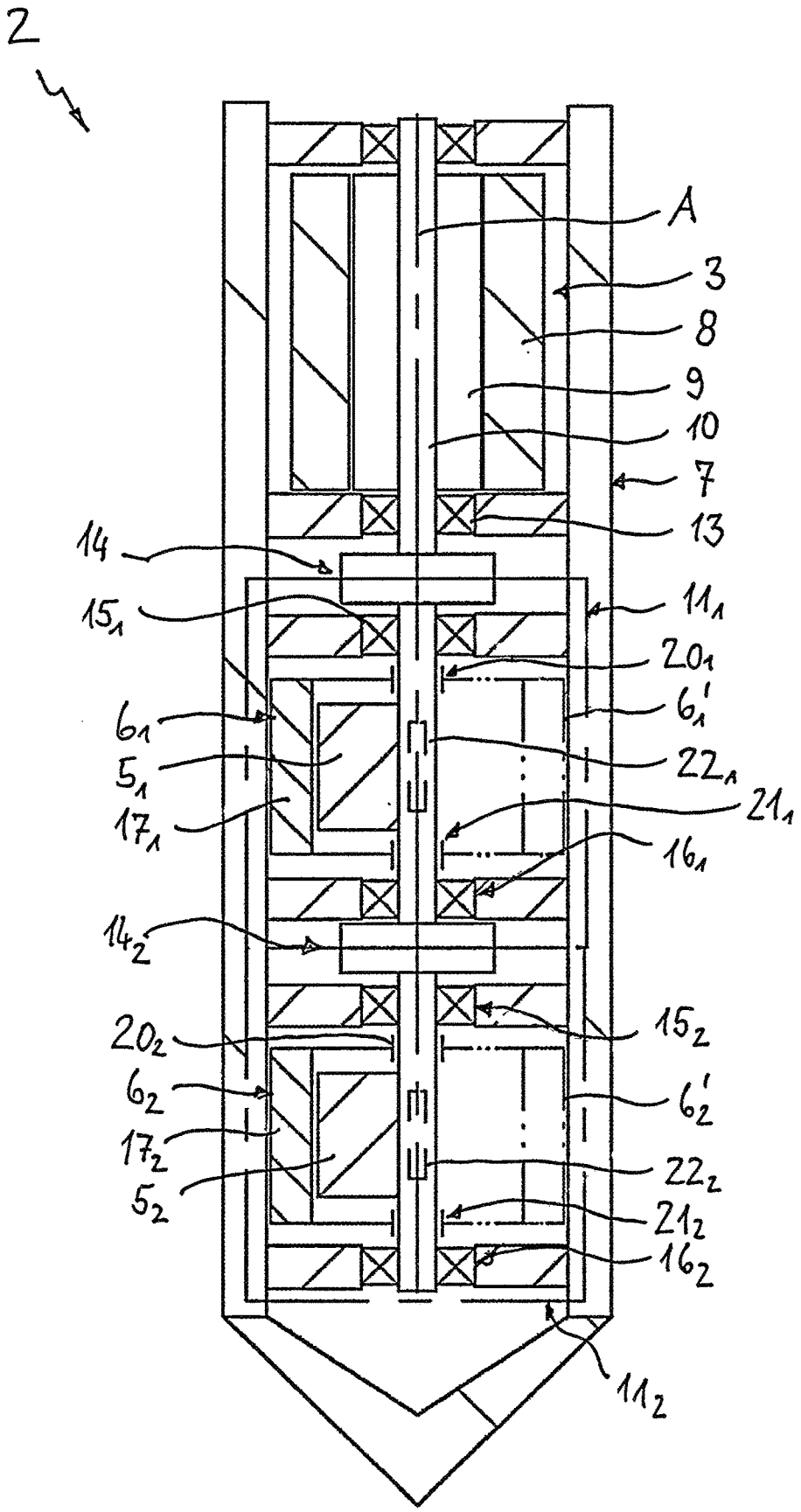
FIG. 5 shows a depth vibrator in a third embodiment in a longitudinal cross-section.

FIG. 5 shows a depth vibrator 2 in a further embodiment. The latter for the most part corresponds to the embodiment according to FIGS. 1 and 2, so that reference is made to the above description with regard to the common features. Identical or modified details are provided with the same reference numbers as in FIGS. 1 and 2 or in FIGS. 3 and 4.

A particular feature of the present embodiment is that depth vibrator 2 comprises a plurality of imbalance assemblies $\mathbf{11}_1$, $\mathbf{11}_2$, which are each accommodated as a unit in housing 7. Each imbalance assembly $\mathbf{11}_1$, $\mathbf{11}_2$ comprises in each case a shaft part $\mathbf{4}_1$, $\mathbf{4}_2$, which in each case is mounted rotatably in housing 7 by means of two bearings $\mathbf{12}_1$, $\mathbf{13}_1$;

$12_2$, $13_2$ and can be driven in a rotating manner by rotary drive 3, as well as a primary and a secondary mass body 5, 6. In each case, a first bearing $12_1$, $12_2$ is arranged above and a second bearing $13_1$, $13_2$ below respective mass bodies 5, 6, in order to ensure a secure radial bearing over the entire length of the shaft. Individual shaft parts $4_1$, $4_2$ are connected to one another by suitable shaft connections $14_1$, $14_2$, such as flange connections, wherein other connecting means are also conceivable. In the present case, two imbalance assemblies $11_1$, $11_2$ are provided, which are driven by a single rotary drive. One skilled in the art will understand that three or more imbalance assemblies can also be used in order to generate still greater vibration amplitudes. The latter are connected to one another in a drivable manner by further shaft connections 14.

Figure 6:
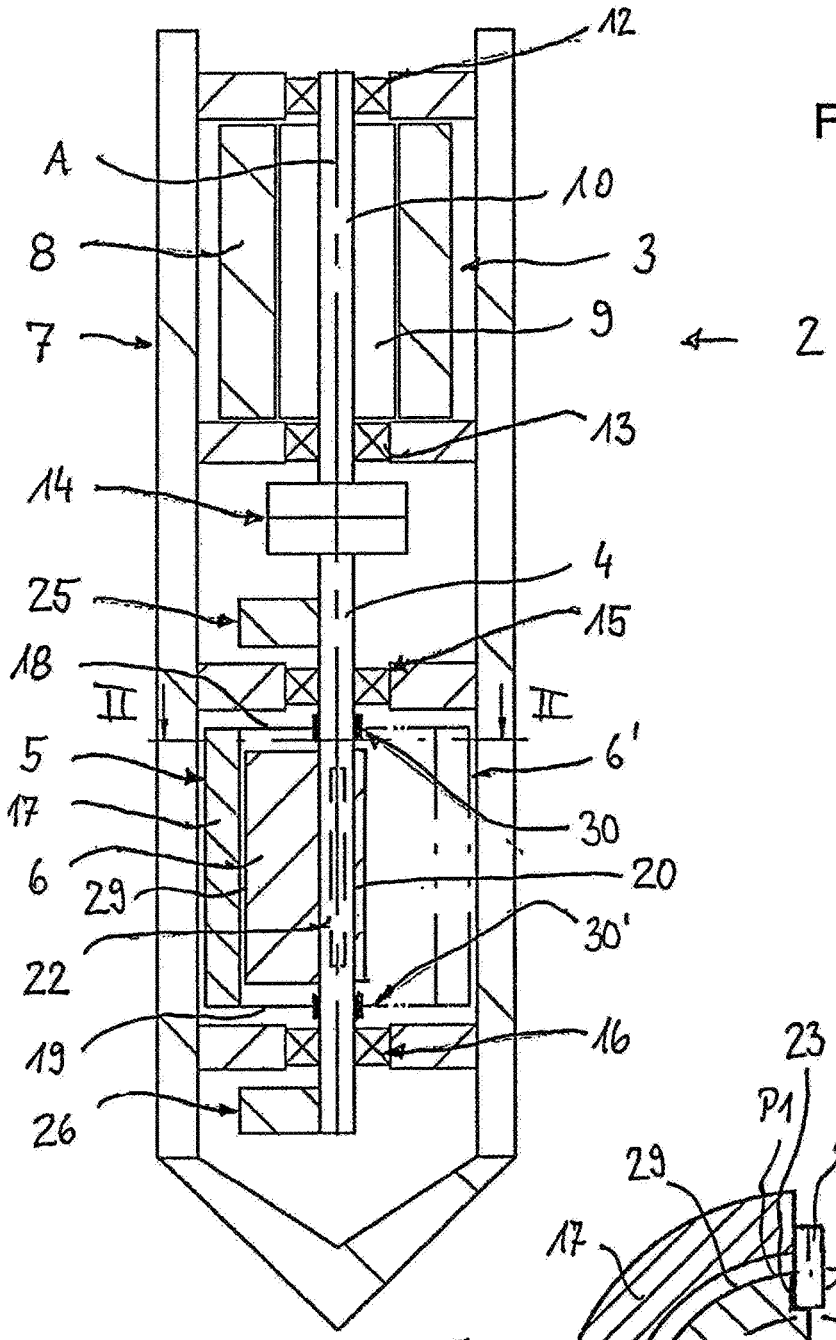
FIG. 6 shows a depth vibrator in a further embodiment in a longitudinal cross-section.
Figure 7:
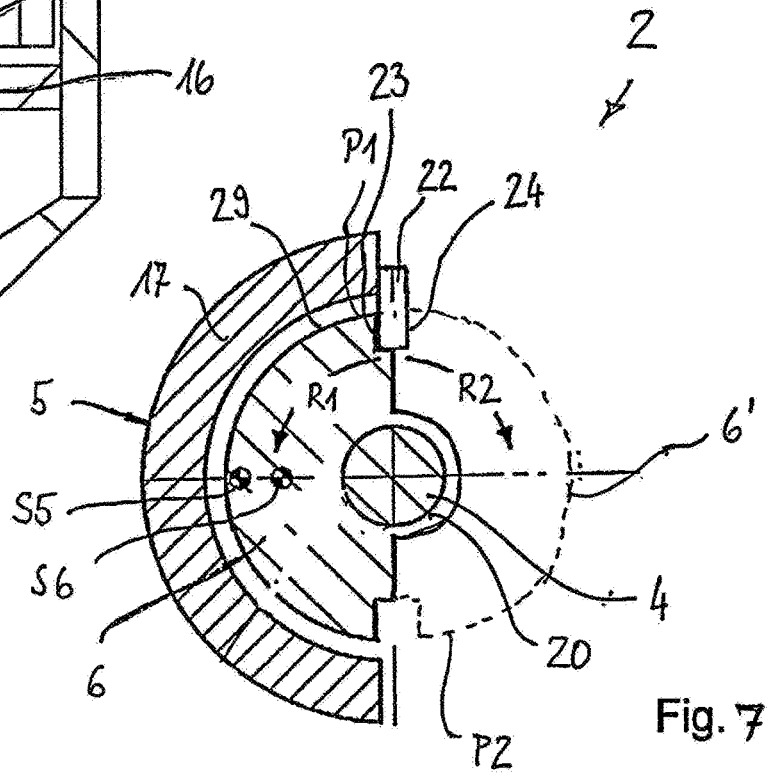
FIG. 7 shows the depth vibrator from FIG. 6 in cross-section along intersecting line II-II from FIG. 6.

FIGS. 6 and 7 show a depth vibrator 2 in a further embodiment. The latter for the most part corresponds to the embodiment according FIGS. 1 and 2, so that reference is made to the above description with regard to the common features. Identical or modified details are provided with the same reference numbers as in FIGS. 1 and 2.

A difference with the present embodiment compared to those according to FIGS. 1 and 2 lies in the assignment of the two mass bodies 5, 6, which are interchanged in the present case. It can be seen that, in the present embodiment according to FIGS. 6 and 7, primary mass body 5, which is connecting non-rotatably to drive shaft 4, is the one with a greater distance of the center of mass S5, whereas mass body 6 swiveling about rotary shaft 4 is the one, center of mass S6 whereof lies on a smaller radius. Non-rotatable mass body 5 comprises an annular segment 17, an upper cover 18 and a lower cover 19, which are connected fixedly to one another. For the non-rotatable connection, shaft toothing 30, 30' or another common shaft-hub connection can be provided between upper and lower covers 18, 19 on the one hand and drive shaft 4 on the other hand. An axial support can take place by means of an axial bearing. Swiveling mass body 6 can be mounted rotatably on drive shaft 4, for example by means of a slide bearing 20 or a slide bush.

Relative rotation positions P1, P2 of swiveling mass body 6 are defined by a stop element 22, against which mass body 6 strikes when rotary drive 3 rotates and is thus arranged in a defined rotation position relative to non-rotatable mass body 5. Rotation stop 22 is constituted as a strip or bar, which is connected to primary mass body 5 and protrudes radially inwards from an inner circumferential surface. As for the rest, the embodiment according to FIG. 6 corresponds, with respect to structure and mode of functioning, to those according to FIGS. 1 and 2, to the description whereof reference is made in this regard.

One skilled in the art will understand that further embodiments are also conceivable, which in the present case are not all disclosed. In particular, it is possible for the embodiment according to FIGS. 3 to 5 to be constituted with a reversed assignment of first and second mass bodies 5, 6, i.e. outer mass body connected non-rotatably to drive shaft 4 and inner mass body mounted swiveling about drive shaft 4.

TABLE OF REFERENCE NUMBERS

2 depth vibrator
3 rotary drive
4 drive shaft
5 mass body
6 mass body
7 housing
8 stator
9 rotor
10 motor shaft
11 imbalance assembly
12,13 bearing
14 connecting means
15,16 bearing
17 annular segment
18 cover part
19 cover part
20, 21 bearing
22 stop element
23 lateral face
24 lateral face
25 additional mass
26 additional mass
27 connecting bridge
28 connecting bridge
29 circumferential surface
30 connection
A rotary axis
P position
R direction
S center of gravity/center of mass

I claim:

1. A depth vibrator for compacting soil, comprising:
a rotary drive having an axis of rotation;
a drive shaft rotatable about the axis of rotation of the rotary drive in a first rotation direction R1 and in second rotation direction R2 opposite R1;
a primary mass body fixed to the drive shaft and rotatable therewith about the axis of rotation;
a stop member fixed to the drive shaft; and
a secondary mass body orbital about the drive shaft between a first rotation position P1 relative to the primary mass body by rotation of drive shaft in said first rotation direction R1 until said secondary mass body abuts one side of said stop member, and a second rotation position P2 relative to the primary mass body by rotation of the drive shaft in the second rotation direction until said secondary mass body abuts an opposing side of said stop member.

2. The depth vibrator for compacting soil according to claim 1, wherein when said secondary mass body is moved into said first rotation position P1 the secondary mass body and primary mass body have substantially the same center of gravity relative to said axis of rotation.

3. The depth vibrator for compacting soil according to claim 2, wherein when said secondary mass body is moved into said second rotation position P2 the secondary mass body and primary mass body have substantially different centers of gravity relative to said axis of rotation.

4. The depth vibrator for compacting soil according to claim 1, wherein a center of gravity of said secondary mass body and of the primary mass body are located at different radial distances from the rotary axis.

5. The depth vibrator for compacting soil according to claim 4, wherein a center of gravity of said secondary mass body is located at a greater radial distance from the rotary axis as a center of gravity of said primary mass body.

6. The depth vibrator for compacting soil according to claim 1, wherein said stop member is connected to the primary mass body.

7. The depth vibrator for compacting soil according to claim 1, wherein said primary mass body comprises a partial-cylindrical segment.

8. The depth vibrator for compacting soil according to claim 7, wherein said primary mass body extends 180° about the rotary axis.

9. The depth vibrator for compacting soil according to claim 1, wherein said secondary mass body comprises an annular cylindrical segment mounted rotatably about both the primary mass body and drive shaft.

10. The depth vibrator for compacting soil according to claim 9, wherein said secondary mass body extends between 160° to 180° about the rotary axis.

11. The depth vibrator for compacting soil according to claim 9, wherein said primary mass body and said secondary mass body axially overlap.

12. The depth vibrator for compacting soil according to claim 9, wherein said secondary mass body is outside the primary mass body.

13. The depth vibrator for compacting soil according to claim 1, wherein said primary mass body and the secondary mass body are mounted on a shaft rotatably seated in bearings.

14. The depth vibrator for compacting soil according to claim 13, wherein said bearings comprise an upper bearing located above the primary mass body and a lower bearing located below the primary mass body.

15. The depth vibrator for compacting soil according to claim 1, wherein the secondary mass body is movable relative to the primary mass body by reversal of the rotation direction of the rotary drive.

16. The depth vibrator for compacting soil according to claim 9, wherein said stop member comprises a bar fixedly connected to the primary mass body.

17. The depth vibrator for compacting soil according to claim 16, wherein said stop member protrudes radially relative to the primary mass body and extends axially along at least one third of the primary mass body.

18. A depth vibrator for compacting soil, comprising:

a rotary drive having an axis of rotation;

a drive shaft rotatable about the axis of rotation of the rotary drive in a first rotation direction R1 and in second rotation direction R2 opposite R1;

a primary mass body fixed to the drive shaft and rotatable therewith about the axis of rotation;

a stop member fixed to the drive shaft; and a secondary mass body comprising a cylindrical segment orbital about the drive shaft and the primary mass body between a first rotation position P1 relative to the primary mass body by rotation of drive shaft in said first rotation direction R1 until said secondary mass body abuts one side of said stop member, and a second rotation position P2 relative to the primary mass body by rotation of the drive shaft in the second rotation direction until said secondary mass body abuts an opposing side of said stop member.

* * * * *